US007478669B2

(12) United States Patent
Okura et al.

(10) Patent No.: US 7,478,669 B2
(45) Date of Patent: Jan. 20, 2009

(54) CORRUGATED FIN FOR INTEGRALLY ASSEMBLED HEAT EXCHANGERS

(75) Inventors: Hiroyuki Okura, Tokyo (JP); Ryoichi Hori, Tokyo (JP); Shinobu Asakawa, Tokyo (JP); Mitsuru Arahori, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 132 days.

(21) Appl. No.: 11/403,207

(22) Filed: Apr. 13, 2006

(65) Prior Publication Data

US 2006/0237173 A1 Oct. 26, 2006

(30) Foreign Application Priority Data

Apr. 14, 2005 (JP) ..... 2005-117543

(51) Int. Cl.
*F28F 13/06* (2006.01)

(52) U.S. Cl. ..... 165/135; 165/140

(58) Field of Classification Search ..... 165/135, 165/140, 152, 153
See application file for complete search history.

(56) References Cited

U.S. PATENT DOCUMENTS 5,033,540 A * 7/1991 Tategami et al. ..... 165/135
5,289,874 A * 3/1994 Kadle et al. ..... 165/152
RE35,710 E * 1/1998 Shinmura ..... 165/140
5,720,341 A * 2/1998 Watanabe et al. ..... 165/135
6,354,368 B1 * 3/2002 Nishishita et al. ..... 165/135
6,408,939 B1 * 6/2002 Sugimoto et al. ..... 165/140
6,837,304 B2 * 1/2005 Makino et al. ..... 165/135

FOREIGN PATENT DOCUMENTS

| | | | |
|---|---|---|---|
| EP | 0 431 917 | A1 | 6/1991 |
| EP | 1 030 153 | A1 | 8/2000 |
| EP | 1 164 345 | A1 | 12/2001 |
| EP | 1 241 424 | A2 | 9/2002 |
| FR | 2 849 174 | A1 | 6/2004 |
| JP | 09-061081 | A | 3/1997 |
| JP | 11-142079 | A | 5/1999 |

* cited by examiner

*Primary Examiner*—Teresa J Walberg
(74) *Attorney, Agent, or Firm*—Foley & Lardner LLP

(57) ABSTRACT

A plurality of tubes and corrugated fins are piled up and arranged alternatively, for integrally assembled heat exchangers. The corrugated fin has fin portions for the heat exchangers and a connecting portion connecting the fin portions. The connecting portion is formed with slits arranged in first and second lines extending in a longitudinal direction of the fin and at least one louver between the slits in the lines. The slits in the first line and the slits in the second line traverse a top portion and a bottom portion adjacent to the top portion of the fin and the louver is formed on an intermediate portion between the top portion and the bottom portion so that the louver is located between the space of the slits in the first line and the space of the slits in the second line.

19 Claims, 4 Drawing Sheets

CORRUGATED FIN FOR INTEGRALLY ASSEMBLED HEAT EXCHANGERS

BACKGROUND OF THE INVENTION

1. Field of the Invention

The present invention relates to a corrugated fin for integrally assembled heat exchangers which are integrally arranged next to each other, each having a plurality of tubes and corrugated fins which are arranged alternatively.

2. Description of the Related Art

A corrugated fin for integrally assembled heat exchangers is described in Japanese Patent Applications Laid-open No. (Tokkaihei) 09-61081 and (tokkaihei) 11-142079. In theses prior arts, the integrally assembled heat exchangers are for different uses, including a plurality of tubes and corrugated fins, each having a first fin portion and a second fin portion respectively for the heat exchangers, which are arranged alternatively and piled up. The first and second corrugated fin portions are connected by a connecting portion, which is formed with slits in order to suppress heat transfer between the adjacent heat exchangers through the connecting portion.

However, the above-described conventional corrugated fin has problems in sufficiently decreasing a heat transfer amount between the heat exchangers through the connecting portion because the connecting portion is too short to radiate heat therefrom sufficiently, although the slits can decrease the heat transfer amount between the heat exchangers to some extent.

It is, therefore, an object of the present invention to provide a corrugated fin for integrally assembled heat exchangers that overcomes the foregoing drawbacks and can improve heat radiation performance in a connecting portion that connects fin portions of a corrugated fin respectively used for the heat exchangers, suppressing heat transfer between the adjacent heat exchangers.

SUMMARY OF THE INVENTION

According to an aspect of the present invention there is provided a corrugated fin for integrally assembled heat exchangers, the heat exchangers having a plurality of tubes and corrugated fins which are piled up in a state where the tubes and the corrugated fins are arranged alternately, and the corrugated fin having top portions and bottom portions, where the corrugated fin includes a plurality of fin portions used for the integrally assembled heat exchangers, respectively, and a connecting portion located on the top portion and the bottom portion and between the integrally assembled heat exchangers and connecting the fin portions with each other. The connecting portion is formed with a plurality of slits arranged only in a first line and a second line which respectively extend in a longitudinal direction of the corrugated fin so that a space is formed between the adjacent slits in the first line and between the adjacent slits in the second line, respectively, and the connecting portion is also provided with at least one louver partially cut to raise between the slits in the first and second lines. The slits in the first line and the slits in the second line are set to traverse the top portion and the bottom portion adjacent to the top portion of the corrugated fin and extend from a first portion formed between the traversed top portion and a bottom portion adjacent to the traversed top portion and opposite to the traversed bottom portion with respect to the traversed top portion to a third intermediate portion formed between the traversed bottom portion and a top portion adjacent to the traversed bottom portion and opposite to the traversed top portion through a second intermediate portion formed between the traversed top portion and the traversed bottom portion, where the first intermediate portion, the second intermediate portion and the third intermediate portion are continuously connected through the traversed top portion and the traversed bottom portion. The louver is formed on an intermediate portion formed between the top portion and the bottom portion so that the louver is located between the space of the slits in the first line and the space of the slits in the second line.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
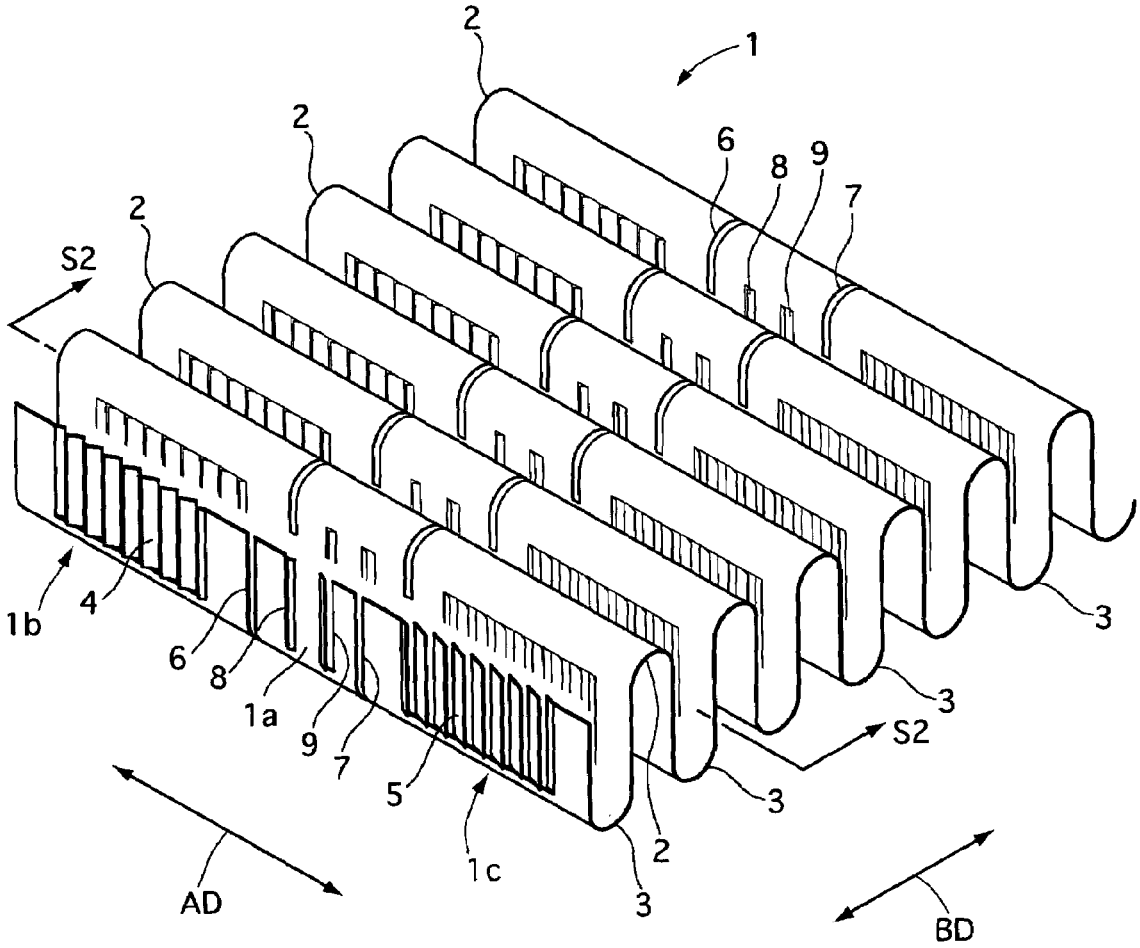
FIG. 1 is a perspective view showing a corrugated fin used for integrally assembled heat exchangers of an embodiment according to the present invention.

Throughout the following detailed description, similar reference characters and numbers refer to similar elements in all figures of the drawings, and their descriptions are omitted for eliminating duplication.

A corrugated fin for integrally assembled heat exchangers of an embodiment according to the present invention will be described with reference to the accompanying drawings.

The integrally assembled heat exchangers are for different uses, functioning as, for example, a radiator and a condenser of a motor vehicle. The heat exchangers are arranged next to each other in a longitudinal direction BD of a corrugated fin 1 (corresponding to a width direction of the heat exchangers), so that their heat exchanger cores are arranged as partially shown in FIG. 4. Its arrangement is set similarly to that of the prior art described in the Japanese Applications Laid-open No. (Tokkaihei) 09-61081 for example.

The heat exchanger cores have a plurality of radiator tubes 10 and radiator-core side fin portions 1*b* which are piled up at a radiator core side in a state where they are arranged alternatively, and a plurality of condenser tubes 11 and condenser-core side fin portions 1*c* which are piled up at a condenser core side in a state where they are arranged alternatively.

The radiator-core side fin portions 1*b* and the condenser-core side fin portions 1*c* are arranged in a lateral direction AD (corresponding to a longitudinal direction of a motor vehicle body when the radiator and the condenser are mounted on it) and connected by connecting portions 1*b*. They are provided with a plurality of louvers 4 and 5 thereon, respectively. The first and second portions 1*b* and 1*c* and the connecting portions 1*a* are corrugated to have a plurality of top portions 2 and bottom portions 3 extending in the lateral direction AD so as to form a corrugated fin 1.

The corrugated fin 1 is made of aluminum, and formed with the plurality of radiator louvers 4 on intermediate portions, formed between the top portions 2 and the bottom portions 3, of the radiator-core side fin portions 1*b*, and the plurality of condenser louvers 5 on intermediate portions, formed between the top portions 2 and the bottom portions 3, of the condenser-core side fin portions 1*c*. The radiator louvers 4 and the condenser louvers 5 are slanted in directions opposite to each other in the embodiment, but they may be slanted in the same direction.

The connecting portions 1*a* are formed with slits 6 and 7 arranged in first and second lines and louvers 8 and 9 arranged in two lines.

The slits 6 and 7 extend from a first intermediate portion to a third intermediate portion through one adjacent top portion 2, a second intermediate portion and one adjacent bottom portion 3 which are continuously formed in this order, and have a predetermined length W1. The slits 6 and 7 and their adjacent ones are apart from each other in the first and second lines by a predetermined space length W2 in the longitudinal direction BD, respectively.

Figure 3:
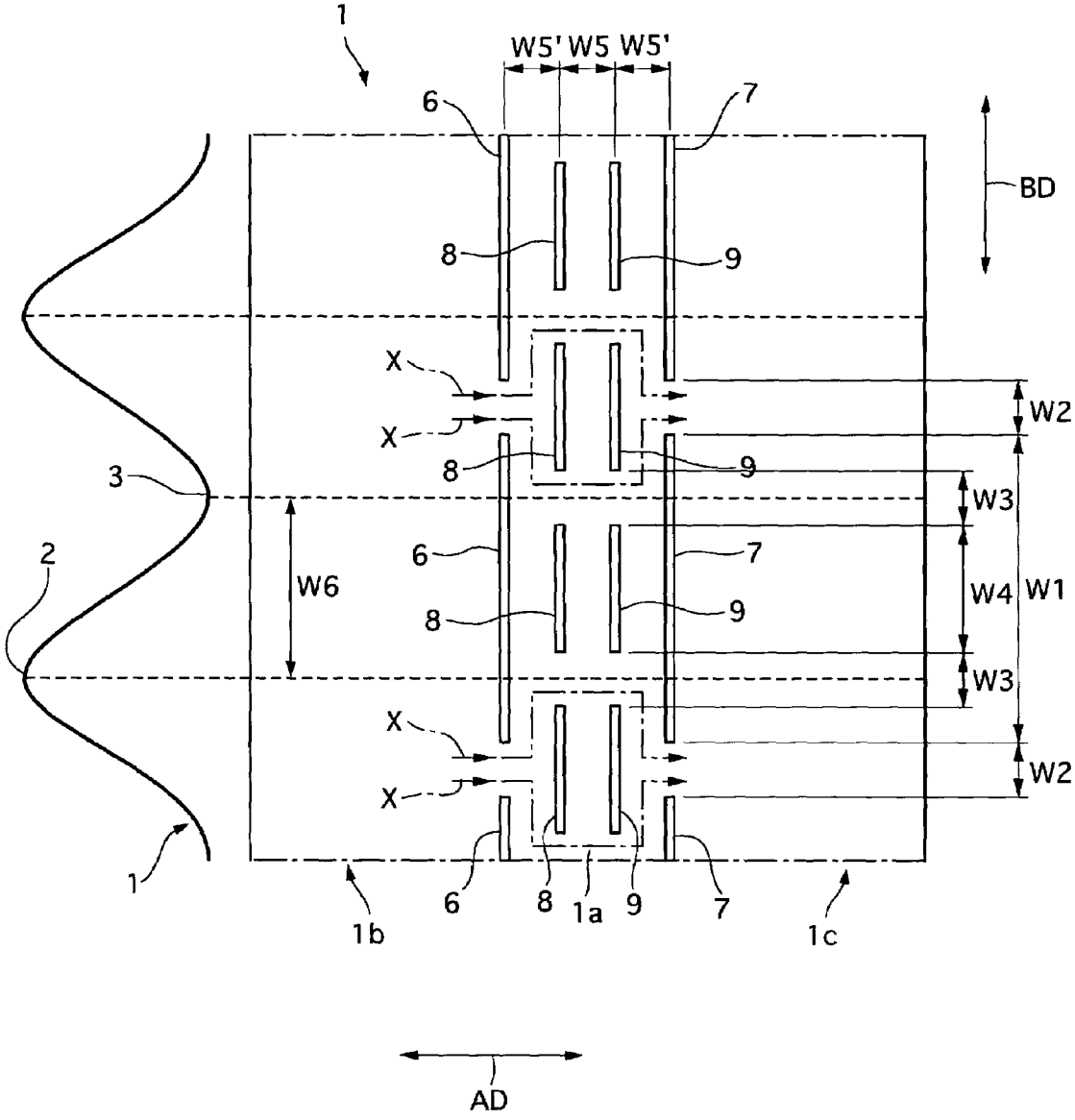
FIG. 3 is an illustration explaining slits and louvers formed on a connecting portion of the corrugated fin of the embodiment, omitting louvers formed on fin portions of the corrugated fin shown in FIGS. 1 and 2.

The slits 6 and 7 and the louvers 8 and 9 are illustrated in detail in FIG. 3, in which its left part shows a side view of a part of the corrugated fin 1 and its right part shows a plan view of the same. The slits 6 and the slits facing each other in the lateral direction AD are located at the same positions in the longitudinal directions BD. Note that louvers 4 and 5 are omitted in FIG. 3 for facilitating visualization.

The louvers 8 and 9 have a predetermined length W4, which is longer than the space length W2 and also than longitudinal lengths of the louvers 4 and 5. The louvers 8 and 9 and their adjacent louvers 8 and 9 are apart from each other in the longitudinal direction BD by a predetermined space length W3, respectively. The louvers 8 and 9 are formed between the slits 6 and 7 on each intermediate portion of the corrugated fin 1. The louvers 8 and 9 are slanted in directions opposite to each other in the embodiment so that the louvers 8 are slanted in the same direction as the radiator louvers 4 are and the louvers 9 are slanted in the same direction as the condenser louvers 5 are. Instead of the above-described louvers 8 and 9 having inclinations in the opposite directions, they may have inclinations in the same direction.

A space between the louvers 8 and 9 is set to have a predetermined length W5. A space between the slits 6 and the louvers 8 and a space between the louvers 9 and the slits 7 are set equally to have a predetermined space length W5' in the lateral direction AD, which is shorter a little than the length W5.

Incidentally, the top portions 2 and their adjacent bottom portions 3 are apart from each other in the longitudinal direction BD by a predetermined length W6.

In this embodiment, the slits 6 are preferable to be arranged in one line (the first line) and the slits 7 are also preferable to be arranged in one line (the second line), although they can be arranged respectively in plural lines. Setting more than one lines adjacent to each other for each of the slits 6 and 7 cannot often ensure sufficient stiffness of the corrugated fin 1 while forming the louvers 4, 5, 8 and 9 and/or corrugating fin material.

On the other hand, the louvers 8 and 9 may be set respectively in plural lines, whose number can be set arbitrarily, allowing for a length between the slits 6 and 7.

An added length (W1+W2) is set non-integral times as long as the length W6. The lengths W1 to W6 can be set arbitrarily.

The above-described corrugated fin is manufactured as follows.

First, aluminum sheets in a strip-like shape are prepared as the fin material, and they are processed one by one.

The aluminum sheet is notched by a not-shown cutter so as to form the slits 6 and 7 thereon. In this slit forming process, the slits 6 and 7 are obtained by shearing off the aluminum sheet and their widths may be arbitrary, extended or not extended. The slits 6 and 7 may be extended, for example as a draft holes, in this slit forming process or a fin brazing process, but their width extensions are not necessary. They may be formed by blanking of press.

Then, the aluminum sheet is corrugated by passing through a pair of corrugating rollers of a not-shown corrugating device to form a corrugated sheet. At the same time, the louvers 4, 5, 8 and 9 are formed by cutting and raising them from the aluminum sheet to obtain the corrugated fin 1.

During this corrugating, cutting and raising process, the slits 6 are deformed to have an extended opening, with a predetermined width, directed outward (a left side of the corrugated fin 1 shown in FIG. 3) of the corrugated fin 1, due to stress caused during the process of forming the louvers 4 and 8 and stress caused during the process of corrugation.

Similarly, the slits 7 are deformed to have an extended opening, with predetermined width, directed outward (a right side of the corrugated fin 1 shown in FIG. 3), in a direction opposite to a direction of the slits 6, of the corrugated fin 1, due to the stress caused during the cutting and raising process for forming the louvers 4 and 8 and the stress caused during the process of corrugation.

Figure 4:
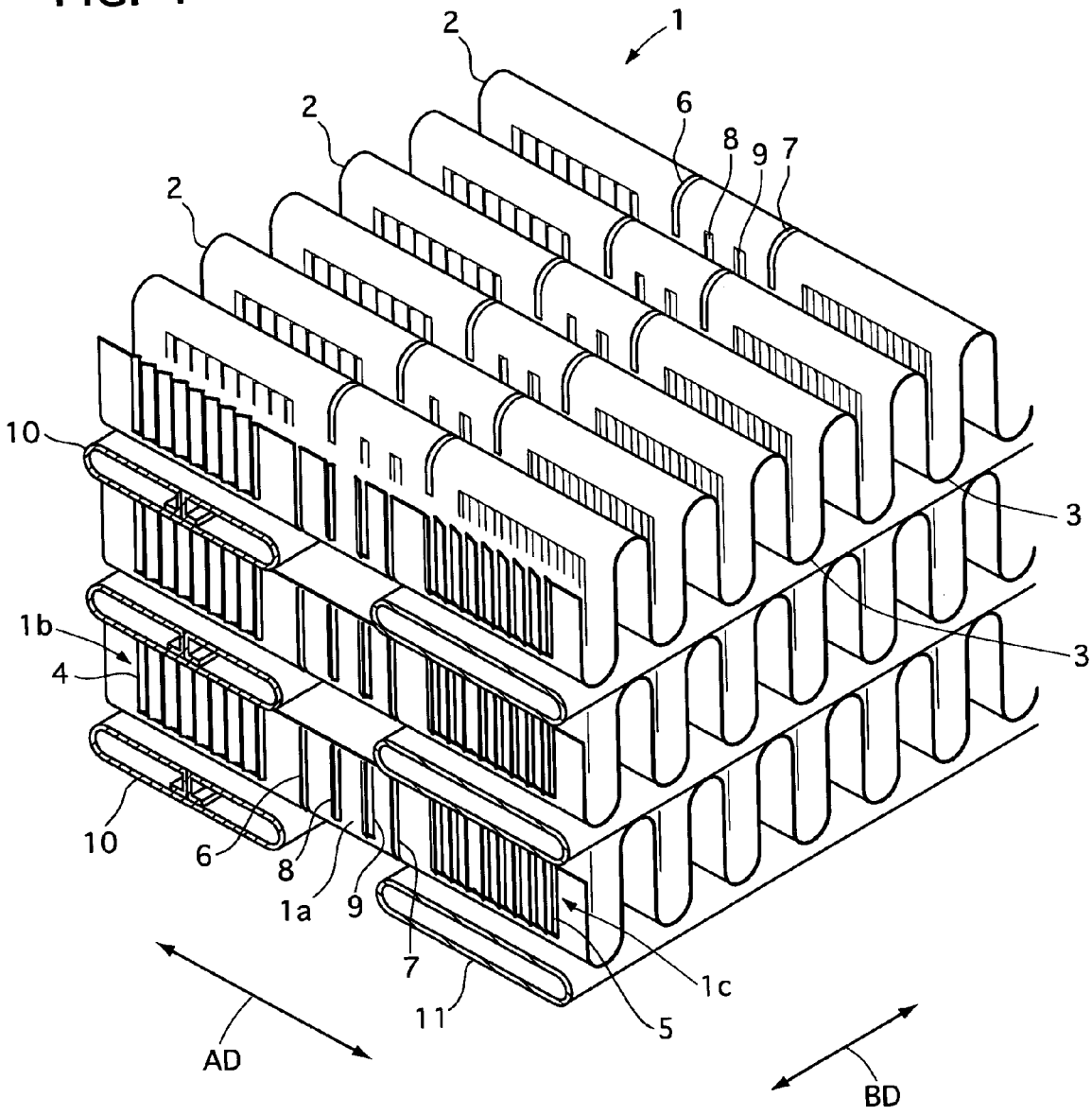
FIG. 4 is a perspective view showing two cores of the integrally assembled heat exchangers to which the corrugated fins of the embodiment shown in FIGS. 1 to 3 are applied.

The above-constructed corrugated fins 1 are, as shown in FIG. 4, arranged alternatively with the radiator tubes 10 and the condenser tubes 11, respectively. They are piled up to form the radiator core and the condenser core in a state where one sheet of the corrugated fin 1 is used for the both cores of the integrally assembled heat exchangers as a common corrugated fin of them.

These integrally assembled heat exchangers are mounted on the vehicle body with a not-shown fan driven by an electric motor.

The operation of the corrugated fin for the integrally assembled heat exchangers of the embodiment will be described.

Coolant flowing in the radiator tubes 10, usually having a temperature between approximately 110° C. and approximately 60° C., is cooled by exchanging heat between the coolant and the air, generated by the fan and/or movement of the motor vehicle, flowing through the radiator-core side fin portions 1*b* with the louvers 4.

Cooling medium flowing in the condenser tubes 11, usually having a temperature between approximately 80° C. and approximately 40° C., is cooled by exchanging heat between the cooling medium and the air, generated by the fan and/or movement of the motor vehicle, flowing through the condenser-core side fin portions 1*c* with the louvers 5.

As described above, heat transfers from the radiator tubes 10 toward the condenser tubes 11 through the connecting portions 1*a* due to temperature difference between the coolant and the cooling medium, thereby heating up the cooling medium to decrease coolability of the condenser. Note that the heat transfers from the condenser toward the radiator through the connecting portions 1*a* under some use conditions of the radiator and according to a use purpose of the radiator.

Figure 2:
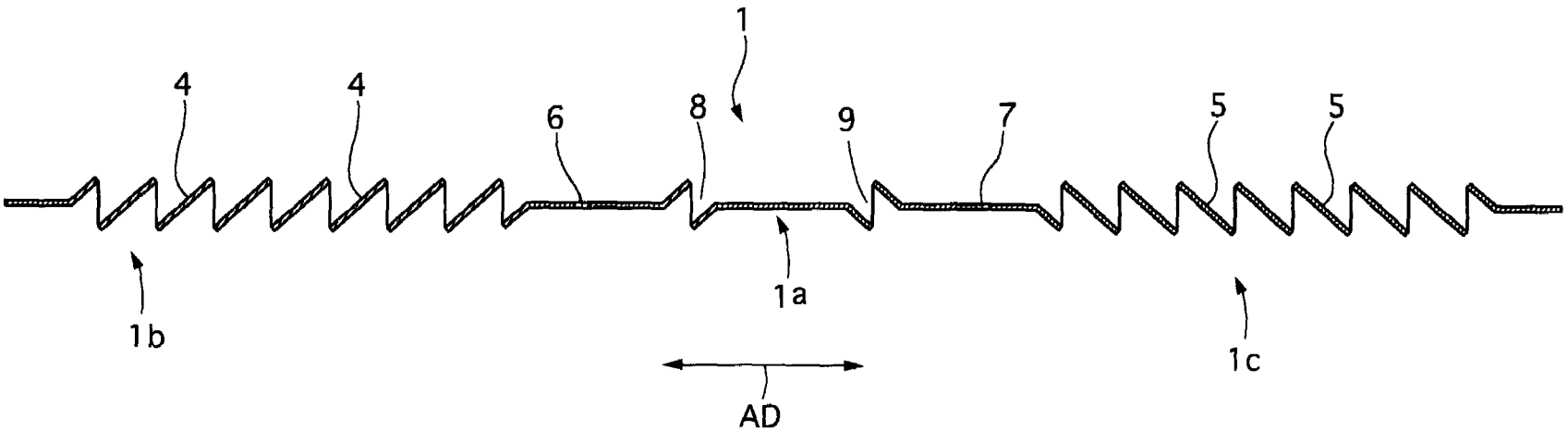
FIG. 2 is a sectional view of the corrugated fin taken along the lines S3-S3 of FIG. 1.

As shown in FIG. 3, in the corrugated fin 1 of the embodiment, slits 6 and 7 are formed to have the predetermined length W1, being respectively spaced by the predetermined length W2 from the adjacent slits 6 and 7, to traverse the top portion 2 and the bottom portion 3. In addition to that, as shown in FIGS. 1, 2 and 4, the louvers 8 and 9 are provided on the intermediate portions formed between the top portion 2 and the bottom portion 3 and between the slits 6 and 7. The spaces between the slits 6 and 6 and the spaces between the slits 7 and 7 are isolated from each other in the lateral direction AD by the louvers 8 and 9.

Therefore, as shown in FIG. 3, heat transfer passages X and Y from the radiator tubes 10 toward the condenser tubes 11 become sufficiently long by bypassing the louvers 8 and 9, thereby suppressing the heat transfer amount therebetween. In addition, the louvers 8 and 9 located between the slits 6 and 7 improve heat radiation and heat rejection performance in the connecting portion 1*a* of the corrugated fin 1.

Further, the slits 6 and 7 are deformed, during the corrugating, cutting and raising process, to extend their openings to have the predetermined length, being directed toward the outside of the corrugated fin 1 in the lateral direction AD. Therefore, they can improve the heat radiation and heat rejection performance in the connecting portion 1*a* of the corrugated fin 1 by easily passing the air through the openings, which can be formed without an additional process of extending the widths of the slits 6 and 7. Note that deformation of slits 6 and 7 to extend their openings is not necessarily needed for achieving the purpose of the present invention.

The corrugated fin 1 for the integrally assembled heat exchangers of the embodiment has the following advantages.

The corrugated fin 1 can improve the heat radiation performance in the connecting portion 1*a* of the corrugated fin 1 by forming the louvers 8 and 9 located between the slits 6 and 7, the louvers 8 and 9 and sufficiently long heat transfer passages X and Y bypassing the louvers 8 and 9.

The added length (W1+W2) is set non-integral times as long as the length W6, which can remove a synchronized process of a slit forming process and a louver forming process, accordingly enabling the corrugated fin 1 to be manufactured easily and at low cost.

In addition, this brings the spaces having the length W2 and located between the slits 6 and 7 to be positioned erratically with respect to the corrugated fin 1. Therefore, this can prevent the spaces between the slits 6 and 7 from being always formed on the same positions, such as the top portions 2 or the bottom portions 3, due to time lag between the slit forming process and the louver forming process.

The slits 6 and 7 facing each other in a lateral direction AD are located at the same positions in the longitudinal direction BD, which can provide the sufficiently long heat-transfer passages X and Y.

The slits 6 and 7 are obtained by shearing off the aluminum sheet to form the draft holes, enabling them to be formed easily and at low cost.

The louvers 8 and 9 between the slits 6 and 7 are longer in the longitudinal length than the louvers 4 and 5 on the radiator-core side fin portions 1*b* and the condenser-core side fin portions 1*c*, which can improve insulation effectiveness in the connecting portions 1*a*.

While there have been particularly shown and described with reference to preferred embodiments thereof, it will be understood that various modifications may be made therein.

For example, another slit or other slits may be formed between the louvers 8 and 9, under a condition of avoiding an arrangement of adjacent slits in the latter case.

The integrally assembled heat exchangers may employ other types of heat exchangers instead of a combination of the radiator and the condenser.

While there have been particularly shown and described with reference to preferred embodiments thereof, it will be understood that various modifications may be made therein, and it is intended to cover in the appended claims all such modifications as fall within the true spirit and scope of the invention.

The entire contents of Japanese Patent Application (Tokugan) No. 2005-117543 filed Apr. 14, 2005 is incorporated herein by reference.

What is claimed is:

1. A corrugated fin for integrally assembled heat exchangers, the heat exchangers having a plurality of tubes and corrugated fins which are piled up in a state where the tubes and the corrugated fins are arranged alternately, and the corrugated fin having top portions and bottom portions, the corrugated fin comprising:

a plurality of fin portions used for the integrally assembled heat exchangers, respectively;

a connecting portion located on the top portion and the bottom portion and between the integrally assembled heat exchangers and connecting the fin portions with each other, the connecting portion being formed with a plurality of slits arranged only in a first line and a second line which respectively extend in a longitudinal direction of the corrugated fin so that a space is formed between the adjacent slits in the first line and between the adjacent slits in the second line, respectively, and the connecting portion being provided with at least one louver partially cut to raise between the slits in the first and second lines, wherein the slits in the first line and the slits in the second line traverse the top portion and the bottom portion adjacent to the top portion of the corrugated fin and extend from a first intermediate portion formed between the traversed top portion and a bottom portion adjacent to the traversed top portion and opposite to the traversed bottom portion with respect to the traversed top portion to a third intermediate portion formed between the traversed bottom portion and a top portion adjacent to the traversed bottom portion and opposite to the traversed top portion through a second intermediate portion formed between the traversed top portion and the traversed bottom portion, the first intermediate portion, the second intermediate portion and the third intermediate portion being continuously connected through the traversed top portion and the traversed bottom portion, and wherein the louver is formed on an intermediate portion formed between the top portion and the bottom portion so that the louver is located between the space of the slits in the first line and the space of the slits in the second line.

2. The corrugated fin of claim 1, wherein an added length (W1+W2) is set non-integral times as long as a length W6, where W1 is a longitudinal length of the slit, W2 is a length of the space between the adjacent slits, and W6 is a longitudinal length between the top portion and the bottom portion adjacent to the top portion of the corrugated fin.

3. The corrugated fin of claim 2, wherein the slits facing each other in a lateral direction of the corrugated fin are located at the same positions in the longitudinal direction.

4. The corrugated fin of claim 3, wherein the slits are formed by shearing-off fin material.

5. The corrugated fin of claim 4, wherein the slits are formed to have a draft hole.

6. The corrugated fin of claim 5, wherein the louvers located between the slits are longer in a longitudinal length than louvers provided on the fin portions.

7. The corrugated fin of claim 6, wherein the slits are formed to be directed outward of the corrugated fin in the lateral direction.

8. The corrugated fin of claim 1, wherein the slits facing each other in a lateral direction of the corrugated fin are located at the same positions in the longitudinal direction.

9. The corrugated fin of claim 8, wherein the slits are formed by shearing-off fin material.

10. The corrugated fin of claim 9, wherein the slits are formed to have a draft hole.

11. The corrugated fin of claim 10, wherein the louvers located between the slits are longer in a longitudinal length than louvers provided on the fin portions.

12. The corrugated fin of claim 11, wherein the slits are formed to be directed outward of the corrugated fin in the lateral direction.

13. The corrugated fin of claim 1, wherein the slits are formed by shearing-off fin material.

14. The corrugated fin of claim 13, wherein the slits are formed to have a draft hole.

15. The corrugated fin of claim 14, wherein the louvers located between the slits are longer in a longitudinal length than louvers provided on the fin portions.

16. The corrugated fin of claim 15, wherein the slits are formed to be directed outward of the corrugated fin in a lateral direction of the corrugated fin.

17. The corrugated fin of claim 1, wherein the louvers located between the slits are longer in a longitudinal length than louvers provided on the fin portions.

18. The corrugated fin of claim 17, wherein the slits are formed to be directed outward of the corrugated fin in a lateral direction of the corrugated fin.

19. The corrugated fin of claim 1, wherein the slits are formed to be directed outward of the corrugated fin in a lateral direction of the corrugated fin.

* * * * *